United States Patent [19]

Narayan et al.

[11] 4,092,399

[45] May 30, 1978

[54] RECOVERY OF URANIUM FROM CARBONATE LEACH SOLUTIONS

[75] Inventors: Kailash Narayan, Westlake Village; Richard D. Pick, Thousand Oaks, both of Calif.

[73] Assignee: Atlantic Richfield Company, Los Angeles, Calif.

[21] Appl. No.: 746,447

[22] Filed: Dec. 1, 1976

[51] Int. Cl.[2] ..... C01G 43/00; C01G 39/00

[52] U.S. Cl. ..... 423/7; 423/2; 423/15; 423/54

[58] Field of Search ..... 423/2, 7, 15, 54

[56] References Cited

U.S. PATENT DOCUMENTS

| | | | |
|---|---|---|---|
| 2,743,159 | 4/1956 | Lutz | 423/7 |
| 2,780,514 | 2/1957 | Lutz | 423/7 |
| 2,811,412 | 10/1957 | Poirier | 423/7 |
| 2,841,468 | 7/1958 | Wilson | 423/7 |
| 2,982,605 | 5/1961 | Mouret et al. | 423/7 |
| 3,180,703 | 4/1965 | Ableson et al. | 423/7 |
| 3,288,570 | 11/1966 | Henrickson | 423/15 |
| 3,745,119 | 7/1973 | Arine et al. | 423/54 |
| 3,790,658 | 2/1974 | Fox et al. | 423/15 |
| 4,011,296 | 3/1977 | Ruiz et al. | 423/7 |

*Primary Examiner*—Edward A. Miller
*Attorney, Agent, or Firm*—Ronnie D. Wilson

[57] ABSTRACT

The present invention relates to the recovery of uranium from carbonate leach solutions. More particularly, it relates to the recovery of uranium from ammonium carbonate leach solutions having molybdenum as an impurity.

3 Claims, 3 Drawing Figures

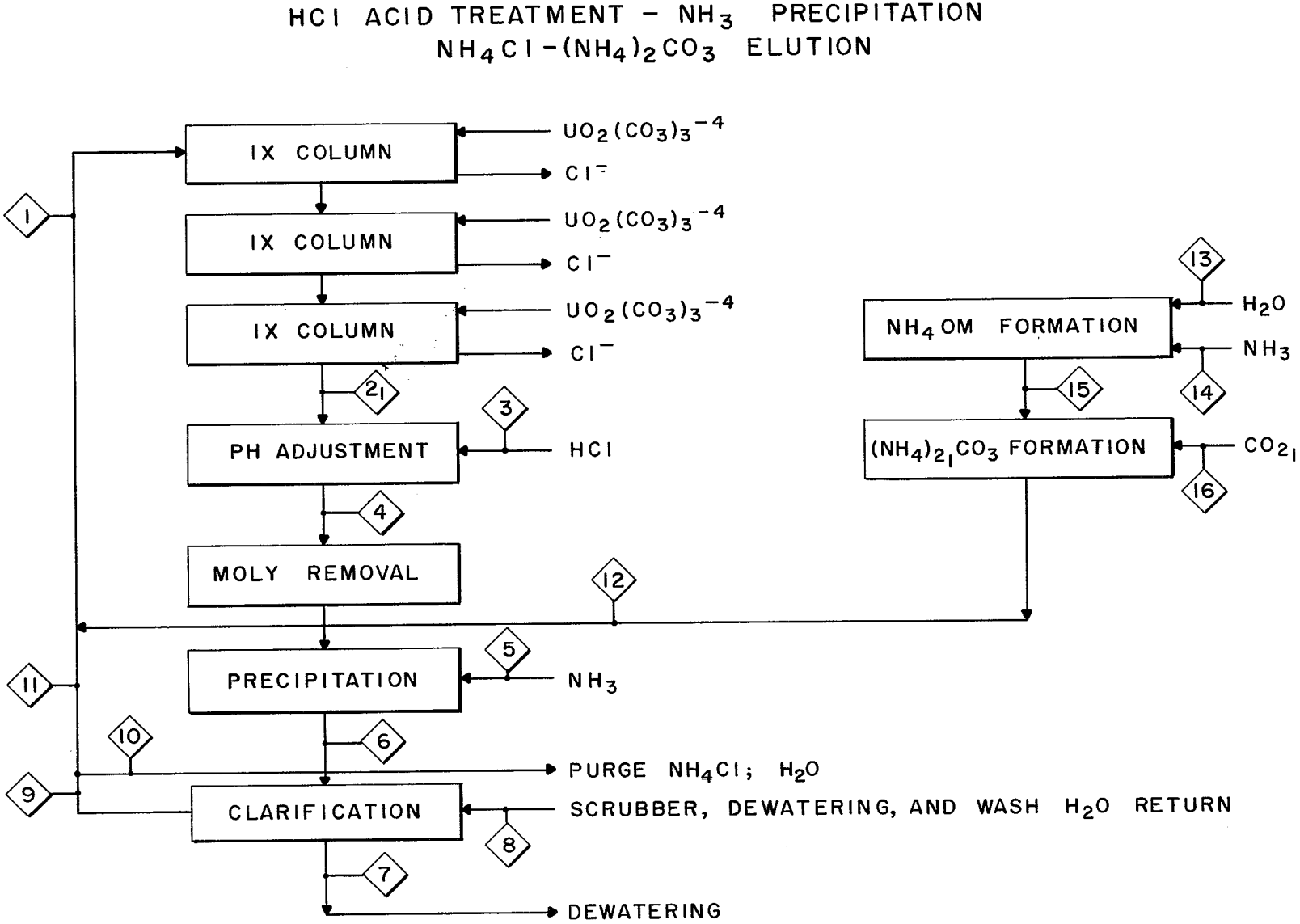
HCl ACID TREATMENT – $NH_3$ PRECIPITATION
$NH_4Cl-(NH_4)_2CO_3$ ELUTION
IX COLUMN
IX COLUMN
IX COLUMN
$UO_2(CO_3)_3^{-4}$
$Cl^-$
$UO_2(CO_3)_3^{-4}$
$Cl^-$
$UO_2(CO_3)_3^{-4}$
$Cl^-$
HCl
PH ADJUSTMENT
MOLY REMOVAL
$NH_4OH$ FORMATION
$(NH_4)_2CO_3$ FORMATION
$H_2O$
$NH_3$
$CO_2$
$NH_3$
PRECIPITATION
PURGE $NH_4Cl$; $H_2O$
SCRUBBER, DEWATERING, AND WASH $H_2O$ RETURN
CLARIFICATION
DEWATERING
1
2
3
4
5
6
7
8
9
10
11
12
13
14
15
16

HCl ACID TREATMENT - $NH_3$ PRECIPITATION
$NH_4Cl$-$(NH_4)_2CO_3$ ELUTION

| STREAM NO. | 1 | $2_1$ | 3 | 4 | 5 | 6 | 7 | 8+ | 9 | 10 | 11 |
|---|---|---|---|---|---|---|---|---|---|---|---|
| STREAM NAME / COMPONENT | FRESH ELUANT | RICH ELUATE | ACID | MOLY FEED | AM-MONIA | PRECIP EFF | CLAR UNDER | CLAR RETURN | CLAR OVER | PURGE | TO MAKEUP |
| WATER | 91699 | 91699 | 5379 | 97791 | — | 97610 | 5524 | $9692_1$ | 101778 | $22_1594$ | 79183 |
| $(NH_4)_4UO_{2_1}(CO_3)_3$ | — | 3487 | — | — | — | — | — | — | — | — | — |
| $NH_4Cl$ | 10009 | 8579 | — | 12099 | — | 12865 | 728 | 728 | $12_1865$ | 2856 | 10009 |
| $(NH_4)_2CO_3$ | 1876 | 1876 | — | — | — | — | — | — | — | — | — |
| HCl | — | — | 2923 | 34 | — | — | — | — | — | — | — |
| $UO_2Cl_{2_1}$ | — | — | — | 2278 | — | — | — | — | — | — | — |
| $(NH_4)_2U_2O_7$ | — | — | — | — | — | 2084 | 2084 | — | — | — | — |
| $NH_3$ | — | — | — | — | 357 | — | — | — | — | — | — |
| $CO_{2_1}$ | — | — | — | (1742*) | — | — | — | — | — | — | — |
| TOTAL LB./ELUTION | 103584 | 105641 | $8302_1$ | $112_1202_1$ | 357 | 112559 | 8336 | $1042_10$ | 114643 | 25450 | $89192_1$ |
| $U_3O_8$ LB./ELUTION | — | 1875 | — | 1875 | — | 1875 | 1875 | — | — | — | — |

*GAS EVOLVED
†WASH OF 2 LB./LB. $U_3O_8$ PLUS DEWATERING

| $12_1$ | 13 | 14 | 15 | 16 | STREAM NO. |
|---|---|---|---|---|---|
| MAKE UP | WATER | AM-MONIA | $NH_4OH$ | $CO_{2_1}$ | STREAM NAME / COMPONENT |
| 12515 | $12_1$867 | ⊢⊣ | $12_1$163 | ⊢⊣ | WATER |
| ⊢⊣ | ⊢⊣ | ⊢⊣ | ⊢⊣ | ⊢⊣ | $(NH_4)_4 UO_{2_1}(CO_3)_3$ |
| ⊢⊣ | ⊢⊣ | ⊢⊣ | ⊢⊣ | ⊢⊣ | $NH_4Cl$ |
| 1876 | ⊢⊣ | ⊢⊣ | ⊢⊣ | ⊢⊣ | $(NH_4)_2 CO_3$ |
| ⊢⊣ | ⊢⊣ | ⊢⊣ | ⊢⊣ | ⊢⊣ | HCl |
| ⊢⊣ | ⊢⊣ | ⊢⊣ | ⊢⊣ | ⊢⊣ | $UO_2Cl_{2_1}$ |
| ⊢⊣ | ⊢⊣ | ⊢⊣ | ⊢⊣ | ⊢⊣ | $(NH_4)_2 U_2O_7$ |
| ⊢⊣ | ⊢⊣ | 664 | ⊢⊣ | ⊢⊣ | $NH_3$ |
| ⊢⊣ | ⊢⊣ | ⊢⊣ | ⊢⊣ | 860 | $CO_2$ |
| ⊢⊣ | ⊢⊣ | ⊢⊣ | 1368 | ⊢⊣ | $NH_4OH$ |
| 14391 | 12867 | 664 | 13531 | 860 | TOTAL LB./ ELUTION |
| ⊢⊣ | ⊢⊣ | ⊢⊣ | ⊢⊣ | ⊢⊣ | $U_3O_8$ LB./ ELUTION |

RECOVERY OF URANIUM FROM CARBONATE LEACH SOLUTIONS

The use of aqueous solutions of ammonium carbonates to leach uranium from its ore has long been known. Molybdenum is often found as a contaminant of uranium-bearing ores. At least a portion of the molybdenum content of the ore is dissolved during alkaline leaching of the uranium and is present in the resulting leach solutions.

In the very early days of the industry, uranium was recovered from those leach solutions by precipitation techniques. More recently strong base quartenary amine anion exchange resins have been utilized to recover uranium from ammonium carbonate leach solutions. Molybdenum, either as a molybdate or as a molybdenum-containing anionic complex, is an important interfering element in processes using an anion exchange resin for the recovery of uranium from aqueous solutions.

It is common knowledge that both uranium and molybdenum will be loaded on an anion exchange resin from an ammonium carbonate leach solution coming in contact with same. Elution of uranium and molybdenum from the resin is also wellknown. In order to separate uranium and molybdenum present in the uranium-rich eluate, sulfuric acid is added to lower the pH of the solution. Subsequently, the acidic solution is then contacted with activated carbon to remove the molybdenum. The molybdenum-free solution from the activated carbon is neutralized to precipitate uranium which is then generally de-watered and dried for shipment in the form of "yellow cake".

Previously, processes utilizing the above set forth steps have encountered problems in regard to product quality even with extensive washing and repulping. Further, the prior processes have introduced various ions into the system, such as sulfate, which must be eventually purged before continuing to further steps in the recovery process. The prior art has recognized the need for removing molybdenum from a uranium recovery system, but previous processes have had disadvantages.

Therefore, it is an object of the present invention to provide a novel integrated process for the recovery of uranium from carbonate leach solutions.

It is a further object of the present invention to provide a novel integrated process for the recovery of uranium from ammonium carbonate leach solutions.

It is a further object of the present invention to provide a novel integrated process for the recovery of uranium from ammonium carbonate leach solutions having molybdenum as an impurity.

An additional object of the present invention is to provide a novel integrated process for the recovery of uranium from ammonium carbonate leach solutions having molybdenum present as an impurity using known chemical reactions to achieve the desired results.

Further objects and advantages of the present invention will become apparent to those skilled in the art upon reading the following detailed description and examples.

The present invention provides a method for the recovery of uranium from an ammonium carbonate leach solution having molybdenum as an impurity which comprises: separating uranium and molybdenum from the solution with an ion exchange resin, removing the uranium and molybdenum from the resin with a suitable elution solution, separating molybdenum from the uranium-rich eluate via acidification, contacting same with activated carbon, and neutralizing the molybdenum-free solution to precipitate uranium which is subsequently dried to yellow cake.

The drawings comprise a flow chart and the corresponding stream tables.

In accordance with the process of the present invention, an integrated process utilizing the following reactions is practiced:

$$4RCl + (NH_4)_4UO_2(CO_3)_3 \rightarrow R_4UO_2(CO_3)_3 + 4NH_4Cl \quad \text{A.}$$

$$R_4UO_2(CO_3)_3 + 4NH_4Cl \rightarrow (NH_4)_4UO_2(CO_3)_3 + 4RCl \quad \text{B.}$$

$$(NH_4)_4UO_2(CO_3)_3 + 6HCl \rightarrow UO_2Cl_2 + 4NH_4Cl + 3H_2O + 3CO_2 \quad \text{C.}$$

$$(NH_4)_2CO_3 + 2HCl \rightarrow CO_2 + H_2O + 2NH_4Cl \quad \text{D.}$$

$$2UO_2Cl_2 + 6NH_3 + 3H_2O \rightarrow (NH_4)_2U_2O_7 + 4NH_4Cl\ HCl + NH_3 \rightarrow NH_4Cl \quad \text{E.}$$

When it is desired to utilize the carbon dioxide evolved in the acidifying step, reaction C above, in the makeup of the elution solution, then the following reactions are used in addition to the reactions shown above:

$$NH_3 + H_2O \rightarrow NH_4OH\ 2NH_4OH + CO_2 \rightarrow (NH_4)_2CO_3 + H_2O \quad \text{F.}$$

The integrated process of the present invention offers a number of advantages not to be found in other processes having similar objectives. It provides for (1) the formation of a soluble ammonium salt during uranium precipitation which is subsequently utilized in elution of the ion exchange resin, (2) the use of ammonium salts during elution to eliminate the need for extensive washing and/or replacing of ions and associated equipment, (3) a substantial reduction of waste streams, (4) the elimination of dry chemical handling and storage, and (5) the reduction of plant effluent.

In accordance with the integrated process of the present invention, an ammonium carbonate leach solution containing both uranium and molybdenum is contacted with a strong base ion exchange resin to adsorb the uranium and molybdenum as expressed in the equation:

$$4RCl + 4(NH_4)_4UO_2(CO_3)_3 \rightarrow R_4UO_2(CO_3)_3 + 4NH_4Cl$$

This reaction is well-known in the art and may be carried out with any of the suitable resins which are presently on the market.

The next step of the present integrated process provides for the elution of the uranium and molybdenum from the resin with an elution solution of ammonium carbonate, bicarbonate and chloride as expressed by the equation:

$$R_4UO_2(CO_3)_3 + 4NH_4Cl \rightarrow (NH_4)_4UO_2(CO_3)_3 + 4RCl$$

In order to ensure a sharp elution peak, the elution solution should contain carbonate and/or bicarbonate ion. Commonly, soda ash is included for this purpose. However, it has been found that the presence of sodium salts require extensive product washing and repulping because they cannot be sublimed. The use of ammonium carbonate or bicarbonate makes it easier to meet product specifications because it can be sublimed using conventional drying techniques. Since all the ammonium salt impurities can be sublimed, extensive washing and repulping is eliminated.

Before separation of molybdenum from the uranim-rich eluate, it is necessary to lower the pH of same by the addition of hydrochloric acid as expressed in the equation:

$$(NH_4)_4UO_2(CO_3)_3 + 6HCl \rightarrow UO_2Cl_2 + 4NH_4Cl + 3H_2O + 3CO_2$$

Commonly, sulfuric acid is used to lower the pH of the solution in preparation for molybdenum removal; however, sulfuric acid introduces sulfate ions into the system. Since sulfate ions are not the desired counter ion for use in elution, they would have to be kept in check by purging a portion of the solution used to make up the elution solution. In a commercial operation, this purge would have to be quite large. Further the carbon dioxide evolved from the acid treatment of the eluate may be cycled and used for elution solution makeup.

After acid treatment, the uranium-rich eluate is contacted with activated carbon which removes the molybdenum therefrom. This method of removing molybdenum is well-known and should be carried out using conventional techniques.

Uranium is separated from the molybdenum-free solution by precipitating same through the addition of ammonia according to the following equations:

$$2UO_2Cl_2 + 6NH_3 \times 3H_2O \rightarrow (NH_4)_2U_2O_7 + 4NH_4Cl\ HCl + NH_3 \rightarrow NH_4Cl$$

As shown, the addition of ammonia during precipitation combines with the HCl of the acid treatment to form ammonium chloride for use in the elution solution. Therefore, the addition of HCl to prepare the uranium-rich eluate for molybdenum removal, followed by ammonia to precipitate uranium provides a combination for preparing a soluble salt for the resin elution.

It is necessary to the integrated process of the present invention that the elution solution contain from about 1% to about 3% carbonate ion. Preferably, it should contain about 2% carbonate ion.

The carbonate ion concentration of the elution solution may be brought to the required level by the separate addition of ammonium carbonate to the makeup solution prepared by the following equation:

$$NH_3 + H_2O \rightarrow NH_4OH\ 2NH_4OH + CO_2 \rightarrow (NH_4)_2CO_3 + H_2O$$

Having thus set forth the present invention, the following example is presented as being illustrative of the unique features thereof.

The example illustrates the applicability of the integrated process of the present invention to remove uranium from an ammonium carbonate leach solution containing both uranium and molybdenum.

The flow diagram shows the various stages of the process and the direction of flow of solutions and reagents. The blocked numbers utilized in the flow diagram correspond to the stream numbers in the table set forth herein. The ion exchange columns contain 375 cubic feet of resin and load to 5 lbs $U_3O_8$ per cubic foot of resin which provides a total of 12 bed volumes for each column elution. Fresh eluant is two molar in $NH_4Cl$ and 2% $(NH_4)_2CO_3$. Molybdenum is completely removed from the resin in the molybdenum carbon column, but this does not appear in the table. Clarifier Under is set at 25% solids. The displaced water, wash water and scrubber underflow is recycled to the clarifier. Carbon dioxide from the acid treatment is utilized in $(NH_4)_2\ CO_3$ makeup. The table shows the material balance of streams and components thereof in pounds per elution run. The carbon dioxide included under stream #4 in the table illustrates the amount that is either released to the atmosphere or utilized in stream #16.

It is to be understood that the invention is not limited by the specific example and embodiments described hereinabove, but includes such changes and modifications as may be apparent to one skilled in the art upon reading the description and the appended claims.

Having thus described the invention, we claim:

1. A method of recovering uranium from an ammonium carbonate leach solution containing same and molybdenum, which comprises in combination:

(a) contacting said solution with a strong base ion-exchange resin to thereby adsorb uranium and molybdenum, (b) eluting said uranium and molybdenum from said resin with an elution solution of ammonium carbonate/bicarbonate/and chloride, (c) separating molybdenum from the rich eluate from step (b) via lowering the pH thereof with hydrochloric acid and contacting same with activated carbon to thereby adsorb molybdenum, (d) separating uranium from the molybdenum-free solution from step (c) by precipitation through the addition of ammonia, and (e) contacting said step (d) eluate with a carbonate/-bicarbonate solution and recycling same to step (b) for elution.

2. The method of claim 1 wherein carbon dioxide, which is evolved in step (c), is cycled to step (e) for addition to said eluate from step (d) to prepare the solution for recycling to elution step (b).

3. The method of claim 1 wherein said elution solution has a carbonate ion concentration from about 1% to about 3%.

* * * * *

UNITED STATES PATENT OFFICE

CERTIFICATE OF CORRECTION

PATENT NO. : 4,092,399

DATED : May 30, 1978

INVENTOR(S) : Kailash Narayan and Richard D. Pick

It is certified that error appears in the above-identified patent and that said Letters Patent are hereby corrected as shown below:

Col. 2, lines 24 and 25 should read:

$$2UO_2Cl_2 + 6NH_3 + 3H_2O \longrightarrow (NH_4)_2U_2O_7 + 4NH_4Cl$$

$$HCl + NH_3 \longrightarrow NH_4Cl$$

Col. 2, lines 32 and 33 should read:

$$NH_3 + H_2O \longrightarrow NH_4OH$$

$$2NH_4OH + CO_2 \longrightarrow (NH_4)_2CO_3 + H_2O$$

Col. 3, line 11, "uranim-" should read --uranium---.

Col 3, lines 38 and 39 should read:

$$2UO_2Cl_2 + 6NH_3 + 3H_2O \longrightarrow (NH_4)_2U_2O_7 + 4NH_4Cl$$

$$HCl + NH_3 \longrightarrow NH_4Cl$$

UNITED STATES PATENT OFFICE

CERTIFICATE OF CORRECTION

PATENT NO. : 4,092,399

DATED : May 30, 1978

INVENTOR(S) : Kailash Narayan and Richard D. Pick

It is certified that error appears in the above-identified patent and that said Letters Patent are hereby corrected as shown below:

Col. 3, lines 58 and 59 should read:

$$NH_3 + H_2O \longrightarrow NH_4OH$$

$$2NH_4OH + CO_2 \longrightarrow (NH_4)_2CO_3 + H_2O$$

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*